US007194780B2

(12) United States Patent
Shelton

(10) Patent No.: US 7,194,780 B2
(45) **Date of Patent: *Mar. 27, 2007**

(54) KILN CLEANING APPARATUS

(75) Inventor: Jefferson L. Shelton, Jacksonville, AL (US)

(73) Assignee: Halcyon Technologies, Inc., Jacksonville, AL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/003,922

(22) Filed: Dec. 3, 2004

(65) Prior Publication Data

US 2005/0151411 A1 Jul. 14, 2005

Related U.S. Application Data

(62) Division of application No. 10/072,148, filed on Feb. 6, 2002, now Pat. No. 6,839,930.

(51) Int. Cl.
*B08B 9/045* (2006.01)
*B08B 9/093* (2006.01)

(52) U.S. Cl. ..... 15/104.05; 15/104.095; 15/104.16

(58) Field of Classification Search ..... 15/104.05, 15/104.16, 104.095, 104.096, 104.09
See application file for complete search history.

(56) References Cited

U.S. PATENT DOCUMENTS 2,313,042 A * 3/1943 Bay ..... 15/104.095
3,280,416 A * 10/1966 Forsyth ..... 15/104.096
3,852,923 A * 12/1974 Hess ..... 451/484
3,922,746 A * 12/1975 Strunk ..... 15/104.095
4,085,474 A * 4/1978 Murphy ..... 15/104.095
5,070,823 A * 12/1991 Ackerman et al. ..... 122/379
5,307,745 A * 5/1994 Higgins et al. ..... 110/182.5
5,351,631 A * 10/1994 Hill et al. ..... 110/182.5
5,531,189 A * 7/1996 Shelton et al. ..... 122/379
5,813,089 A * 9/1998 Nolan et al. ..... 15/383

* cited by examiner

*Primary Examiner*—Randall Chin
(74) *Attorney, Agent, or Firm*—Smith, Gambrell & Russell

(57) ABSTRACT

An apparatus for cleaning deposits from the interior surfaces of a kiln. The apparatus utilizes a directed high-pressure fluid jet to remove deposits adhering to elements within a kiln. The pressurized fluid is delivered to the fluid jet through the shaft of a rotary drill. The drill shaft is received in a sleeve permitting rotational and longitudinal displacement of the shaft. The sleeve also defines a plenum surrounding the drill shaft to communicate pressurized fluid to the fluid jet throughout longitudinal and rotational displacement of the drill shaft. The drill further utilizes a boring bit suitable for penetrating encrusted deposits to provide the fluid jet access to the interior surfaces of the kiln. For removing severe encrustations, the drill bit may be used to partially penetrate the encrustation and a linear actuator may then be employed to press large portions of the encrustation from the kiln's refractory lining.

14 Claims, 6 Drawing Sheets

KILN CLEANING APPARATUS

This application is a divisional application of prior application Ser. No. 10/072,148, filed Feb. 6, 2002, now U.S. Pat. No. 6,839,930.

TECHNICAL FIELD

This invention relates to the field of industrial kilns. More particularly this invention relates to an improved apparatus for cleaning deposits from the inner refractory surfaces of a kiln. Specifically, the apparatus disclosed may be used to drill, press, or blast deposits from the inner surfaces of a kiln.

BACKGROUND OF THE INVENTION

In the field of industrial kilns, particularly cement kilns, the accumulation of particulate deposits on the inner refractory lining of the kiln is a recurring problem. Buildup in the preheater and riser duct areas can choke off feed pipes and cyclones and greatly affect the efficiency and production performance of the kiln, even to the point of causing unscheduled shutdowns. If the deposits are permitted to accumulate, the high temperatures typically encountered by the interior of the kiln during normal operations will cause the deposits to become encrusted on the kiln's interior surfaces. The exact characteristics of the buildup in preheater towers may vary from plant to plant, and can even vary from hour to hour within the same plant.

Usually, the buildup begins sticking to the walls of the tower with the consistency of talcum powder. Routine cleaning of the deposits is a preferred method of addressing the problem, whereby the deposits are removed before significant accumulation and encrustation occurs. Various strategies in the art for removing deposits during routine cleaning cycles include pneumatic blasting, carbon dioxide explosions, manual air lances, manual jackhammers, and high pressure water blasting. All of these methods cause damage to the refractory lining and expose the operators to dangerous conditions. Moreover, these methods are reactionary to the buildup problem and are intended to minimize rather than eliminate it. These devices generally require access to the interior of the kiln to be effective.

In the case of blast cannons, access is provided to the interior of the kiln through a plurality of spaced apart ports. The ports typically are provided with a refractory protective sleeve for communication between the interior and exterior of the kiln walls. Blast cannons may be provided for each port, or may be moved from port to port to clean various portions of the kiln sequentially. A significant limitation of blast and percussive devices is the difficulty of directing their energy to release particular deposits and their limited effective blast radius.

Increased operational requirements or excessive particulate release may cause the rate of deposit accumulation to exceed the capability of routine cleanings to adequately remove deposit build up. This may lead to encrustation of the deposits on the kiln's refractory walls and occlusion of the access ports. Moreover, incomplete removal of deposits during routine cleaning will also accelerate deposit accumulation and consequent encrustation of the refractory walls as well as occlusion of the access ports.

In the case where the access ports have become fully occluded, many of the devices presently used for routine preventative cleaning are unable to clear the occlusion. In these instances a separate device for penetrating an encrustation to gain access to the interior of the kiln must be installed. In severe cases, the kiln will have to be brought off line before restorative cleaning may be initiated.

The requirement for additional equipment to gain access to the kiln and the manpower required to temporarily install then replace that equipment with the desired cleaning equipment adds significant cost and complexity to the cleaning operation. Moreover, the requirement to bring a kiln off line will adversely effect production capacity.

BRIEF SUMMARY OF THE INVENTION

The present invention addresses these problems in the industry by providing a single apparatus for both preventative and restorative cleaning of the interior refractory wall of a kiln. The device is adapted to be received on a wide variety of kiln access ports, making it particularly suitable for retrofitting to an existing kiln structure. As such, the apparatus of the present invention may be installed while the kiln remains operational. Moreover, the device provides multiple means of access to the interior of the kiln for such cleaning. First, the apparatus provides a rotatable pressurized fluid jet, which directs a pressurized fluid stream to remove deposits accumulating on a kiln refractory lining. The fluid jet of the present invention may be rotated continuously through a full 360 degree range of motion. Second, the apparatus provides for variable insertion of the fluid jet relative the kiln interior, enabling selective adjustment of the effective blast radius of the pressurized fluid stream, thereby permitting more effective removal of deposits. Third, in the event of partial access port occlusion due to deposit build up, the apparatus provides a rotating drill bit to bore through the occlusion, providing fluid jet access to the interior of the kiln without the need for additional boring equipment. Finally, in the event of total port occlusion and encrustation of built up deposits, the drill bit may be used to partially bore through the port occlusion and a linear actuator may then used to press large blocks of encrustation from the refractory wall.

Accordingly, the apparatus of the present invention comprises a rotary drive unit operatively connected to a first end of a longitudinally extending drill shaft. A drill bit is provided at a second end of the drill shaft and oriented for coaxial rotation therewith. The drill shaft is slidably received in a sleeve member, permitting rotational displacement of the drill shaft. A fluid jet, provided proximal the drill bit, projects a pressurized fluid stream, delivered through the drill shaft, for removing accumulated deposits from the kiln's refractory walls.

The apparatus' ability to continuously project a pressurized fluid stream throughout its full rotational displacement is provided by the sealing engagement of the sleeve member with the drill shaft. A pressurized fluid source is communicated to the fluid jet via an inlet port on the sleeve member to a plenum defined between the sleeve member and the drill shaft sealingly received therein. The fluid is then communicated via an aperture in the drill shaft to a chamber defined within the drill shaft and in communication with the fluid jet. The rotation of the aperture within the plenum permits continuous delivery of the pressurized fluid to the fluid jet.

The ability of the apparatus to continuously project a pressurized fluid stream through a range of lateral displacement is achieved by maintaining the position of the drill shaft aperture within the lateral boundaries of the plenum. The thickness of the kiln wall is the primary factor in determining the drill shaft length and amount of lateral displacement the apparatus must achieve. With longer drill shaft lengths, a longer sleeve member and a wider plenum are desirable to adequately support to the drill shaft.

Lateral displacement of the drill shaft may be assisted by a linear actuator operatively connected between the first end of the drill shaft and the second end of the drill shaft.

BRIEF DESCRIPTION OF THE DRAWINGS

Various embodiments of my invention are depicted in the appended drawings which form a part of this disclosure and wherein.

DETAILED DESCRIPTION OF THE INVENTION

Figure 1:
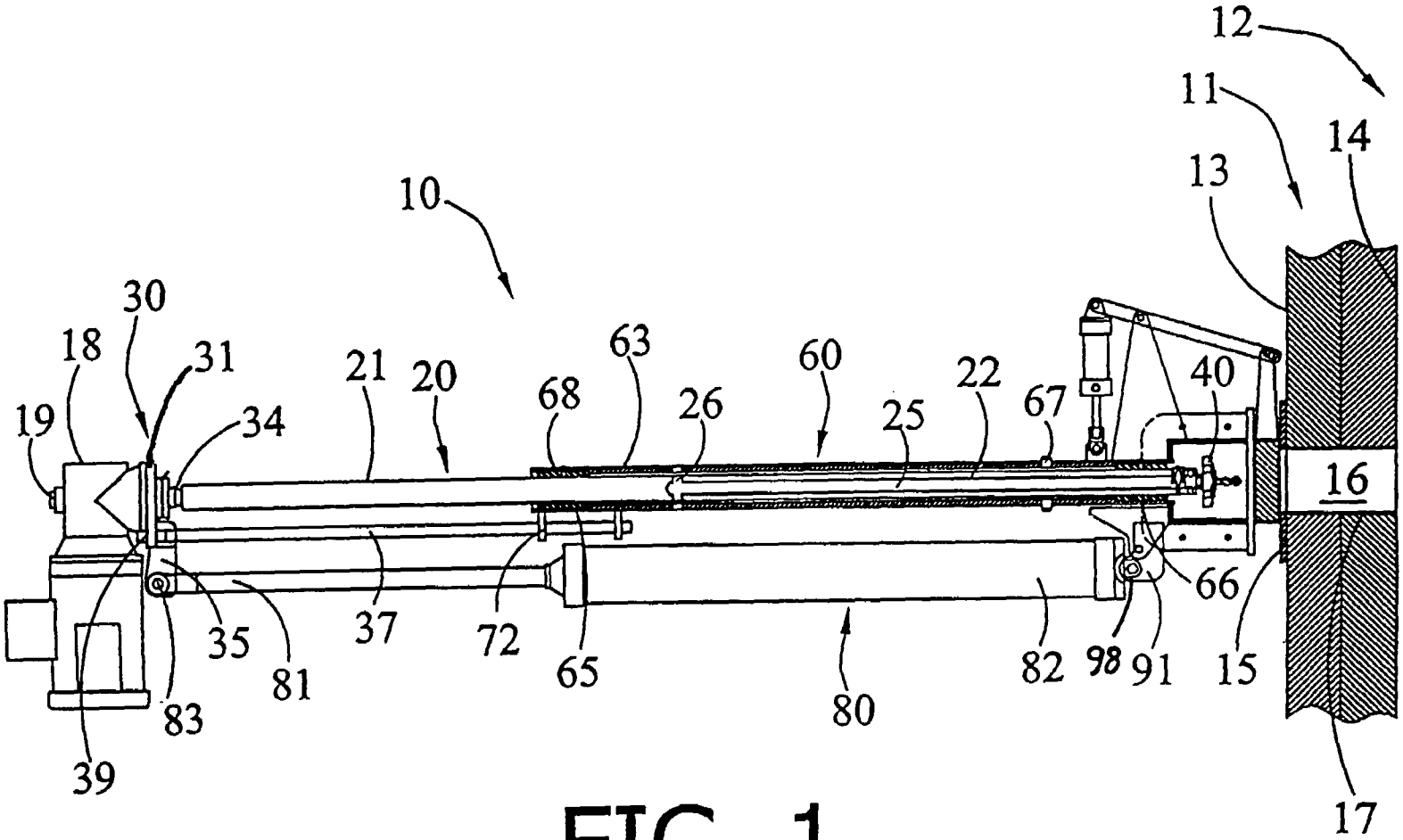
FIG. 1 is a side sectional view of the apparatus attached to a kiln wall with the drill shaft in the retracted position.

Referring to the drawings for a more complete description of the invention the kiln cleaning apparatus 10 is shown mounted to a wall 11 of an industrial kiln 12. Kiln wall 11 includes a duct wall 13 and a refractory lining 14. An industrial kiln 12 may include a plurality of access ports 16 spaced apart throughout wall 11 permitting access to the interior of kiln 12 for cleaning deposits which have accumulated on refractory lining 14 during operation of kiln 12. Each access port 16 will typically include a protective sleeve 17 to prevent damage to refractory lining 14. Support for protective sleeve 17 is provided by a flange 15, which is secured to wall 11.

As may be seen in FIG. 1, the cleaning apparatus 10 comprises a rotary drive unit 18 with its output shaft 19 operatively connected to a first end 21 of a drill shaft 20, via a coupling unit 30. Coupling unit 30 includes a coupling plate 31, a bearing 33, and a bearing retainer 34. Coupling unit 30 is attached to rotary drive unit 18 via attachment means such as screws, bolts, or pins.

At a second end 22 of drill shaft 20 a drill bit 40, suitable for drilling a build up of deposits and encrustation of the same, is attached for coaxial rotation with drill shaft 20. An exemplary drill bit 40 is depicted in greater detail in FIG. 5. However, any drill bit suitable for boring built up deposits and encrustation of said deposits may be utilized with equally effective results. As depicted, a shank 41 of drill bit 40 is received within a chamber 25 defined internal drill shaft 20. Shank 41 is secured within chamber 25 via attachment means 46, which may include a set screw, a shear pin, or a threaded shank.

Drill bit 40 preferably includes a pilot bit 42, to avoid drill bit 40 drift and undesirable contact of drill bit 40 with protective sleeve 17 during boring procedures. Pilot bit 42 will have a substantially smaller diameter than boring bit 43. Boring bit 43 is comprised of a plurality of fingers 44 radially extending from shank 41. Fingers 44 will have least one cutting surface 45 located thereon. Boring bit 43 should have a diameter closely matching a diameter of protective sleeve 17.

Referring again to FIGS 1 and 2, a portion of drill shaft 20 is received by a sleeve member 60 interposed between drill shaft first end 21 and drill bit 40. Sleeve member 60 is attached to an adapter housing 90 proximal drill bit 40 for operative connection of the kiln cleaner 10 to kiln 12 via flange 15. Adapter housing 90 provides alignment of drill shaft 20 relative access port 16, permitting extension of drill shaft 20 and concomitant drill bit 40 boring through deposits which may occlude access port 16 and protective sleeve 17.

The cooperative engagement of drill shaft 20 with sleeve member 60 provides fluid communication means between a pressurized fluid source and a fluid jet 50. At least one inlet port 67, defined between an inner wall 61 and an outer wall 62 of sleeve member 60 receives a pressurized fluid source. A plenum 69, defined between inner wall 61, an outer surface 23 of drill shaft 20 and first and second sealing means 65 & 66, receives the pressurized fluid from inlet port 67. An aperture 26, defined between outer surface 23 and an inner surface 24 of drill shaft 20, receives the pressurized fluid from plenum 69. Chamber 25 in turn receives the pressurized fluid from aperture 26 for subsequent communication to fluid jet 50.

Since plenum 69 surrounds drill shaft 20, fluid communication through aperture 26 may be maintained regardless of the rotational displacement of drill shaft 20. Moreover, fluid communication through aperture 26 may be continuously maintained throughout longitudinal displacement of drill shaft 20, provided that aperture 26 remains positioned between first and second sealing means 65 & 66.

Figure 2:
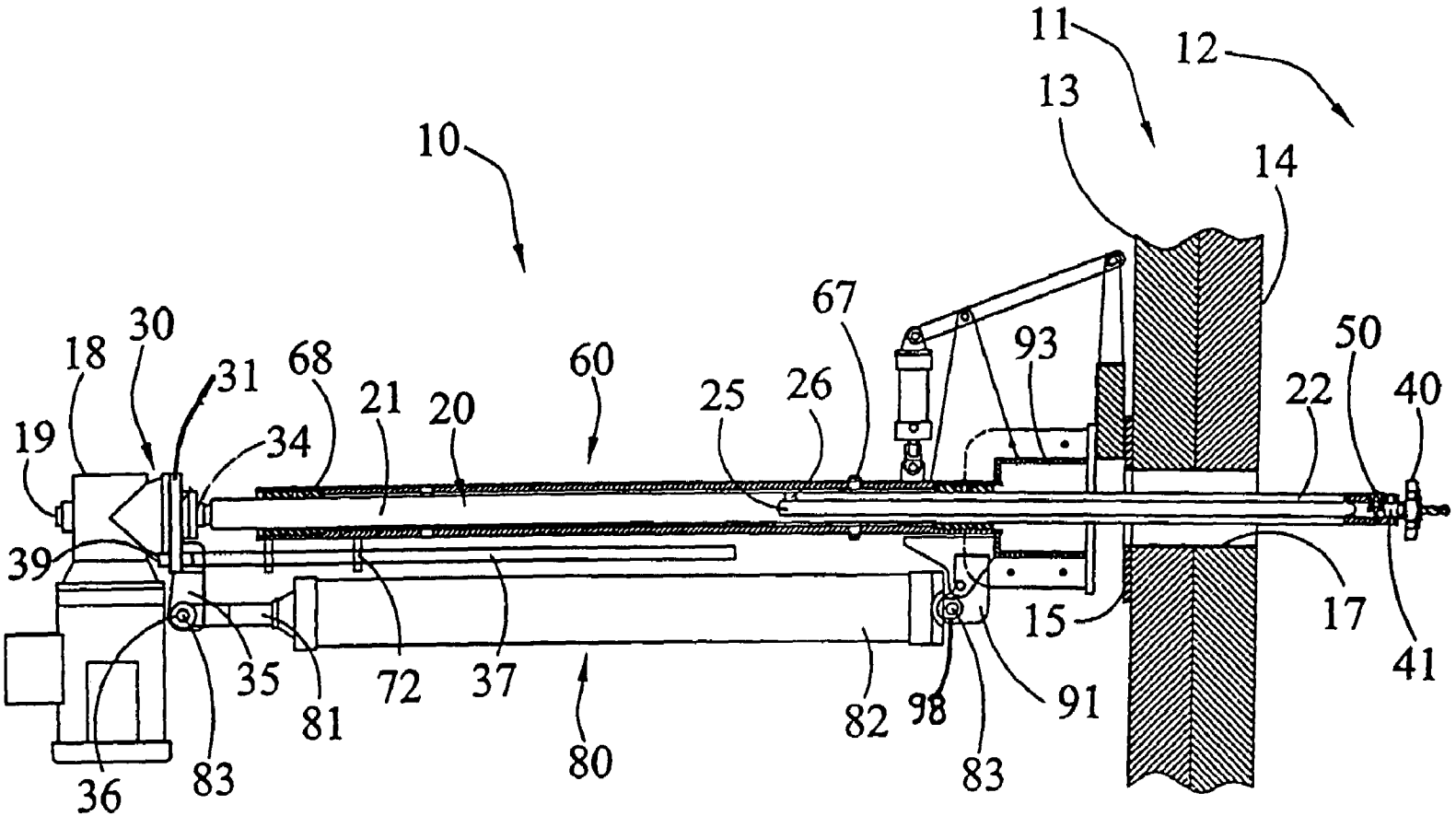
FIG. 2 is a side sectional view of the apparatus attached to a kiln wall with the drill shaft in the extended position.

As shown in FIGS. 1 and 2, a pair of bearings 68 are selected and positioned proximal a first end 63 and a second end 64 of sleeve member 60 and support rotational and longitudinal displacement of drill shaft 20. Bearings 68 may also provide first and second sealing means 65 & 66 for plenum 69. In comparing the drawings of FIGS. 1 and 2, it may be seen that drill shaft 20 has been longitudinally displaced between a retracted position, as depicted in FIG. 1, and an extended position, as depicted in FIG. 2. Comparison of FIGS. 1 and 2 further shows that fluid communication is continuously maintained throughout displacement of drill shaft 20 by maintaining aperture 26 between first and second sealing means 65 & 66.

Figure 6:
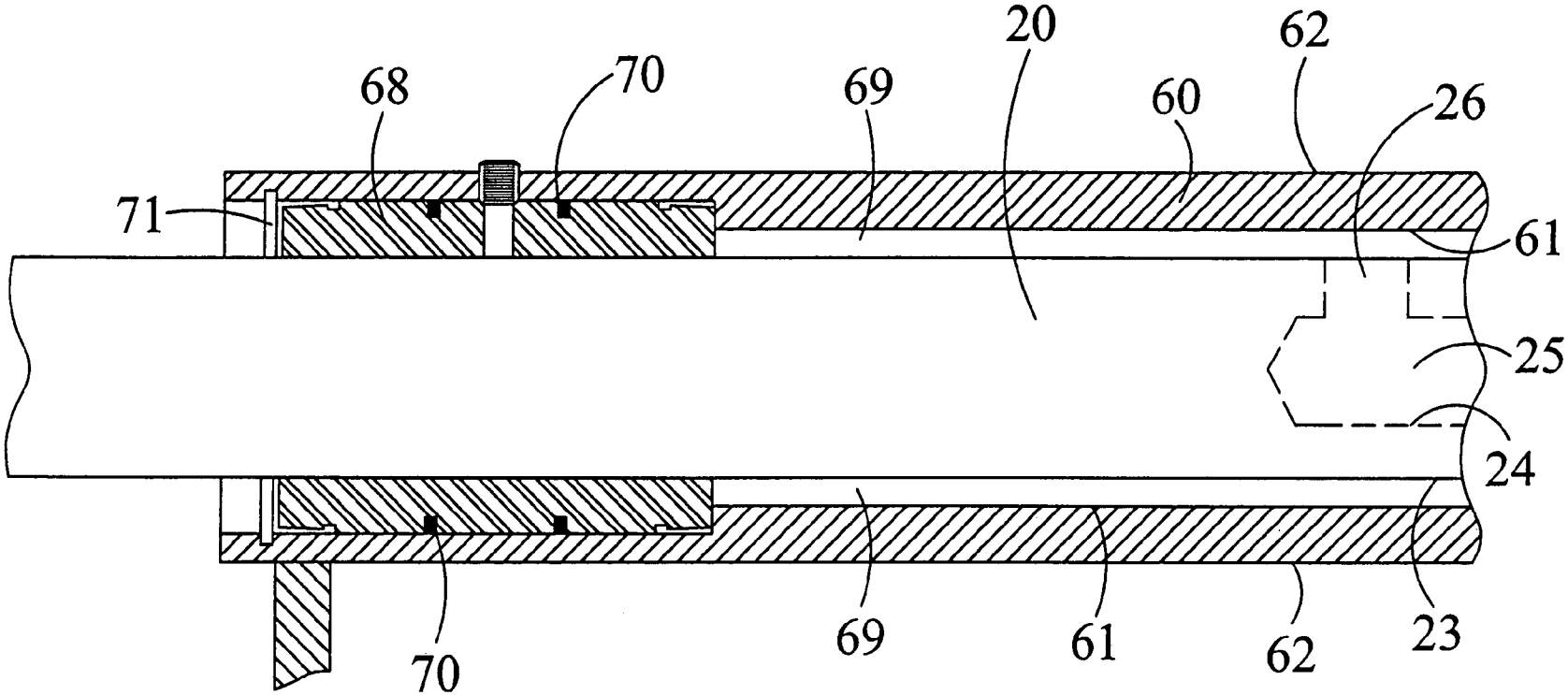
FIG. 6 is a partial sectional view of the sleeve, plenum and seal.

Exemplary sealing means are shown in the detailed drawing of FIG. 6, wherein drill shaft 20 is sealingly received within bearing 68 while O-rings 70 sealingly engage bearing 68 and sleeve member inner wall 61. However, this arrangement is illustrative only, as first and second sealing means 65 & 66 may be employed independent of bearing 68 and may be placed at any position relative sleeve member 60, it being understood that aperture 26 need only be maintained between first and second sealing means 65 & 66 when fluid communication through aperture 26 to fluid jet 50 is required.

The length of drill shaft 20 is selected to obtain a desired penetration into kiln 12 so that the pressurized fluid stream pattern, developed by fluid jet 50, may be employed against deposits adhering to kiln refractory lining 14. As such, the thickness of kiln wall 11 and the anticipated thickness and consistency of the adherent deposits will influence the length of drill shaft 20.

As may be seen in the drawings, a fluid jet 50 is attached at second end 22 of drill shaft 20 proximal drill bit 40 and projecting laterally of drill shaft 20. Fluid jet 50 is in fluid communication with chamber 25, which receives the pressurized fluid source as described above. Fluid jet 50 imparts a desired flow pattern to the pressurized fluid source, which may then be directed to release deposits adhering to refractory lining 14. Since fluid jet 50 is in rotational engagement of with drill shaft 20, deposits may be removed from refractory lining 14 through a full 360 degrees of rotation around access port 16. The surface area radius of refractory lining 14 which may be cleared is dependent upon the effective blast radius of the pressurized fluid flow pattern developed by fluid jet 50.

Figure 5:
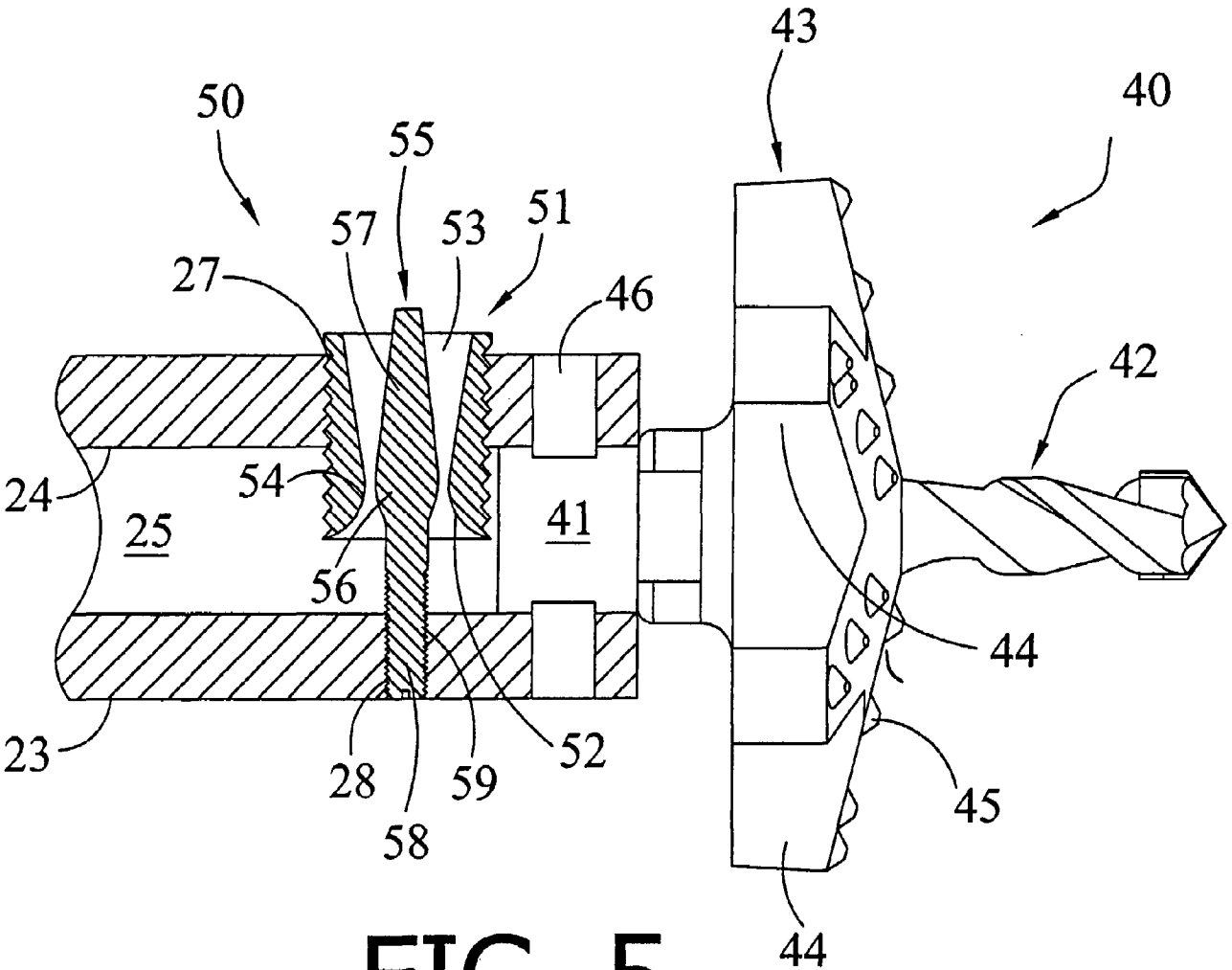
FIG. 5 is a partial sectional view of the drill shaft showing the fluid jet and a drill bit.

As is best seen in the detail drawing of FIG. 5, fluid jet 50 comprises a fluted venturi aperture 51 received in a first bore 27, extending from an outer surface 23 of drill shaft 20 to an inner surface 24 of drill shaft 20. Inner surface 24 defines chamber 25 internal drill shaft 20. Fluted venturi aperture 51 is depicted as a threaded insert, however, any suitable attachment means may be utilized to secure fluted venturi aperture 51 in first bore 27, including an interference fit or a weld. Fluted venturi aperture 51 comprises a flared inlet portion 52, a tapered outlet portion 53, and a constricted throat portion 54 intermediate flared inlet portion 52 and tapered outlet portion 53. Preferably, flared inlet portion 52 will have a greater inlet diameter than an outlet diameter of tapered outlet portion 53.

For improved developement of the desired flow pattern in the pressurized stream, fluid jet 50 further comprises a stylus 55 received coaxial with fluted venturi aperture 51. Stylus 55 comprises a bulbous portion 56 and a tapered end portion 57 axially extending from bulbous portion 56. A lug portion 58 is received in a second bore 28 defined in drill shaft 20 and coaxial first bore 27. Lug portion 58 may be fit in second bore 28, but is preferably inserted via a threaded interface to permit adjustment of stylus 55 to obtain a desired flow pattern and corresponding blast radius. Typically, stylus 55 is positioned within fluted venturi aperture 51 such that bulbous portion 56 is juxtaposed constricted throat portion 54.

Figure 3:
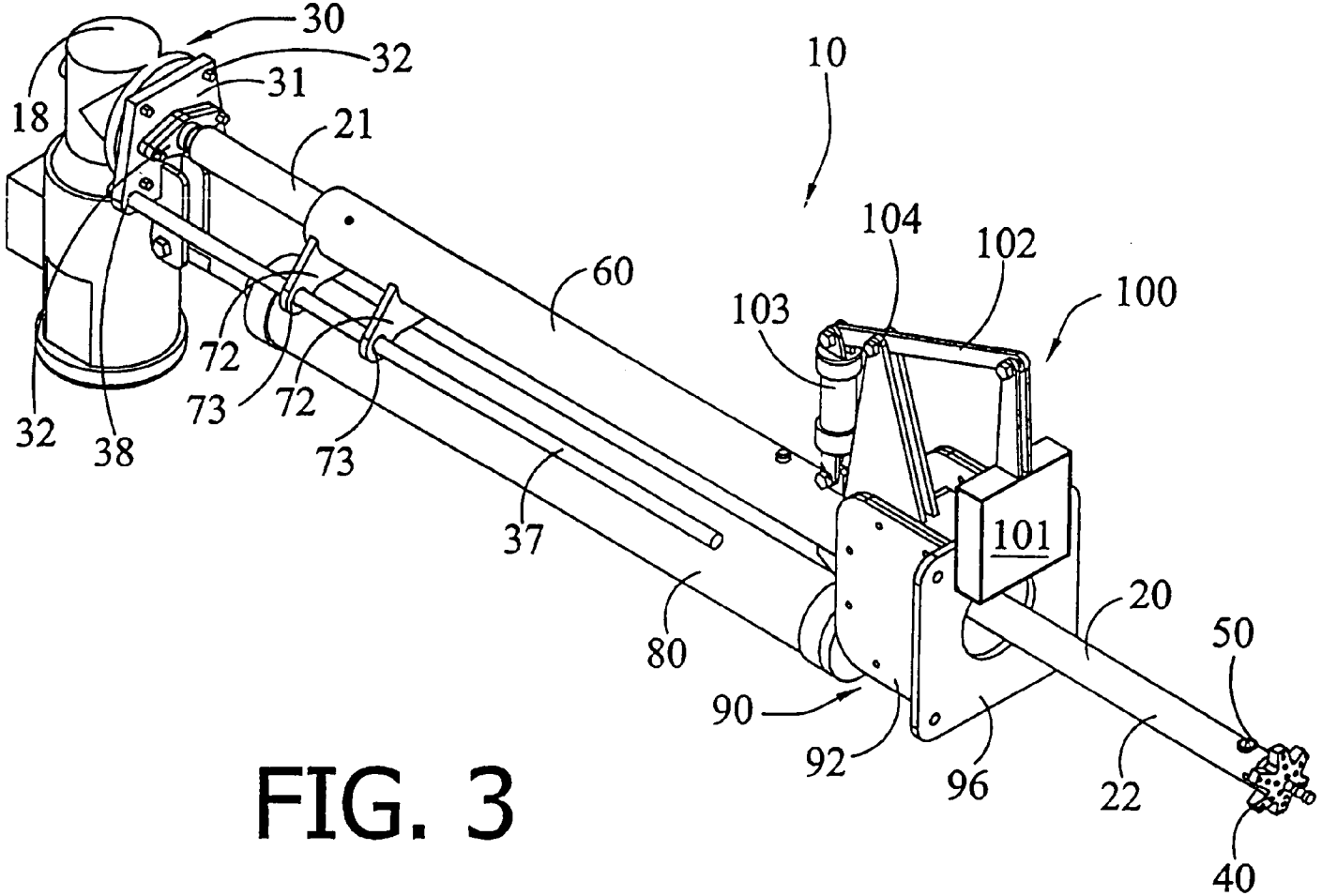
FIG. 3 is a perspective view of the apparatus with the drill shaft in the extended position.
Figure 4:
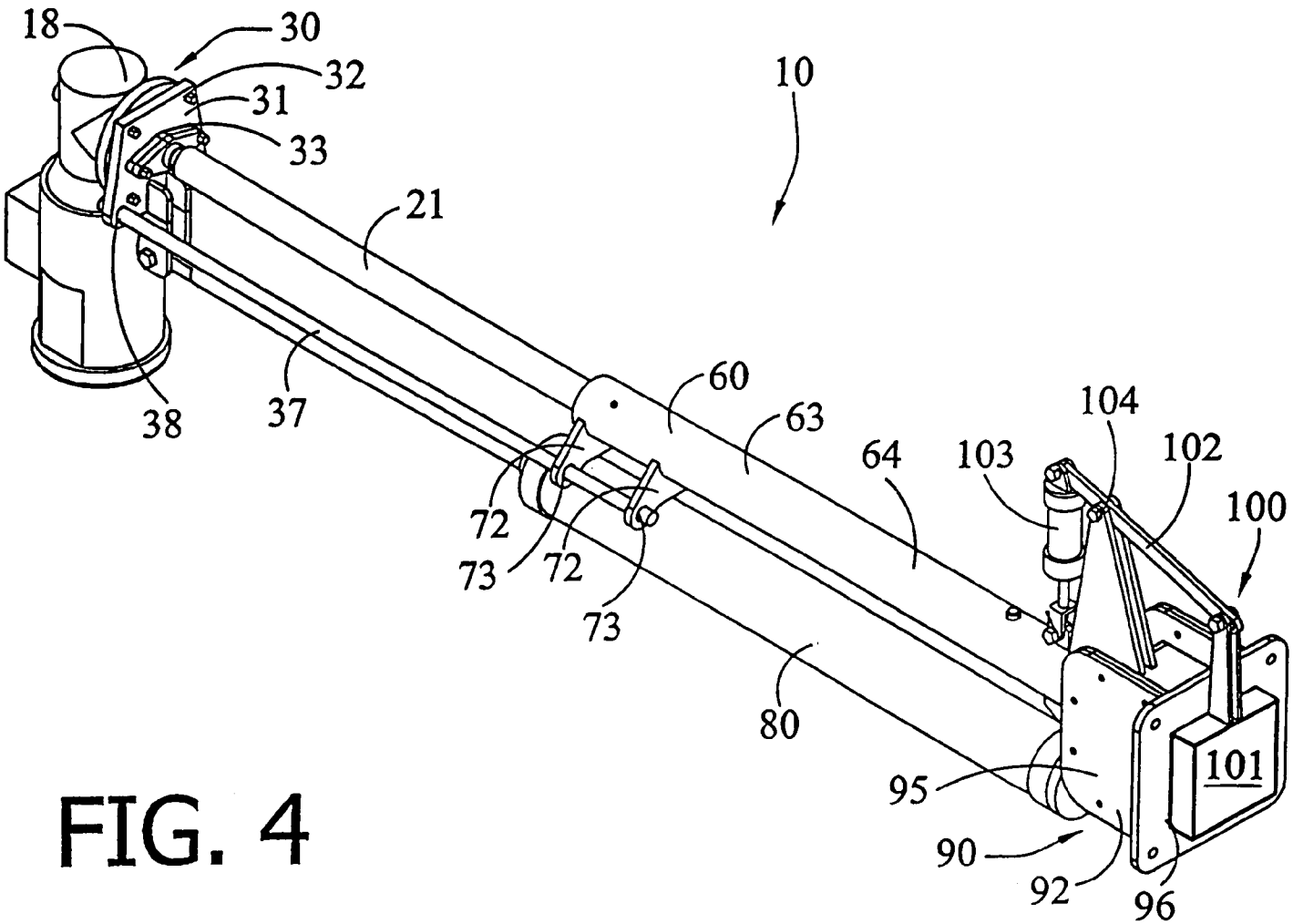
FIG. 4 is a perspective view of the apparatus with the drill shaft in the retracted position.

As seen in the drawings, a linear actuator 80 is operatively connected between coupling unit 30 adapter housing 90. Linear actuator 80 permits selective extension and retraction of drill shaft 20 as seen by comparison of FIGS. 1 & 2 as well as FIGS. 3 & 4. Connection of a first end 81 of linear actuator 80 is provided by a first linear actuator boss 35 located on coupling 30. Attachment means 83, such as pins or bolts, secure first end 81 to receiving point 36. Connection of a second end 82 of linear actuator 80 is provided by a second linear actuator boss 91 located on adapter housing 90. Attachment means 83, such as pins, bolts or screws secure second end 82 to a receiving point 98.

In operation, linear actuator 80 may be selectively engaged to assist boring by urging drill bit 40 against deposit build up which may be occluding or only partially occluding access port 16. Once the occlusion has been cleared, linear actuator 80 may then complete insertion of fluid jet 50 to a desired depth into kiln 12, thereby permitting the removal of adherent deposits by the pressurized fluid stream.

In the event that large deposits or an encrustation of deposits completely occlude port 16 and the refractory lining 14 surrounding port 16, drill bit 40 may be utilized to partially bore into the deposits or encrustation. Linear actuator 80 may then be used as a press to break off large portions of encrustation from refractory lining 14. In the event of severe encrustation, utilization of this procedure may permit continued operation of kiln 12 for a period of time until the kiln may be brought off line to permit more complete encrustation removal from refractory lining 14.

A guide rod 37 assists in maintaining alignment of drill shaft 20 during activation of linear actuator 80. Guide rod 37 is attached to a receiving point 38 on coupling plate 31 and is slidingly received in a bore 73 of at least one guide rod alignment point 72 extending from sleeve member outer wall 62. Additionally, guide rod 37, in cooperation with linear actuator 80, counteracts the torque developed by rotary drive unit 18 during rotary engagement of drill bit 40 against deposits and encrustation.

To assist in maintaining the proper kiln temperature and to protect the kiln cleaner 10 from the deleterious effects of the extreme kiln temperatures, the kiln cleaner 12 contemplated by the present invention may also provide a selectively positionable insulated access port cover plate 101. The access cover mechanism 100 comprises an access cover actuator 103 operatively connected between sleeve second end 64 and a first end of an access cover lever 102. A second end of access cover lever 102 is connected to an extension of cover plate 101. Access cover lever 102 works via fulcrum 104 for operative opening and closing access cover plate 101.

Adapter housing 90 may also include a removable access panel 95, which provides operator access to drill bit 40 and fluid jet 50, permitting cleaning, maintenance, or adjustment of the same without the need to remove the apparatus from its attachment to the kiln 12.

It should be understood that although I have described an exemplary embodiment of my invention in some detail, modifications and variations might be made without departing from the spirit of my invention. Accordingly, I claim as my invention all forms thereof coming within the scope of the appended claims.

What I claim is:

1. An apparatus comprising a rotary drive unit operatively connected to a first end of a drill shaft; a drill bit suitable for drilling deposits, said drill bit attached to a second end of said drill shaft and oriented for coaxial rotation therewith; a sleeve member enclosing an axial portion of said drill shaft intermediate said first end of said drill shaft and said second end of said drill shaft, said sleeve member permitting rotation of said drill shaft therein; a fluid jet projecting from an outer surface of said drill shaft proximal said drill bit, said fluid jet in communication with a pressurized fluid source through said drill shaft; and said sleeve member further comprising fluid communication means for communicating said pressurized fluid source to said drill shaft.

2. The apparatus of claim 1 wherein said fluid communication means comprises a plenum defined by an inner wall of said sleeve member, an outer surface of said drill shaft, and first and second sealing means spaced apart and sealingly engaging said sleeve member and said outer surface of said drill shaft.

3. The apparatus of claim 2, wherein said fluid communication means further comprises at least one fluid inlet defined between an outer wall of said sleeve member and said inner wall of said sleeve member; and at least one aperture defined between said outer surface of said drill shaft and a chamber defined internal said drill shaft, said chamber in fluid communication with said fluid jet.

4. The apparatus of claim 2 wherein said first sealing means is positioned proximal a first end of said sleeve member, and said second sealing means is positioned proximal a second end of said sleeve member.

5. The apparatus of claim 2 wherein said first sealing means is attached at a first end of said sleeve member, and said second sealing means is attached at a second end of said sleeve member.

6. The apparatus of claim 1 wherein said fluid jet comprises a fluted venturi aperture comprising: a flared inlet portion, a tapered outlet portion, and a constricted throat portion interposed between said flared inlet portion and said tapered outlet portion; said flared inlet portion having an inlet diameter greater than an outlet diameter of said tapered outlet portion; and said flared inlet portion having a length substantially shorter than a length of said tapered outlet portion.

7. The apparatus of claim 6 wherein said fluid jet further comprises a stylus, said stylus comprising a bulbous base portion and a tapered end portion extending axially from said bulbous base portion, said stylus interposed within said fluted venturi aperture with said bulbous portion juxtaposed said constricted throat portion and said tapered end portion extending into said tapered outlet portion.

8. The apparatus of claim 7 wherein a first bore, defined between an outer wall of said drill shaft and said chamber, receives said fluted venturi aperture, and a second bore radially opposed to said first bore, said second bore extending outwardly from an inner surface of said chamber; and said stylus further comprises a lug portion which is received in said second bore.

9. The apparatus of claim 8 wherein said stylus is selectively adjustable along a longitudinal axis of said fluted venturi aperture to impart a desired flow pattern to said pressurized fluid.

10. The apparatus of claim 1 wherein said drill shaft is selectively extensible between a retracted position, wherein said drill bit is positioned proximal said sleeve, and an extended position, wherein said drill bit is displaced distal said sleeve.

11. The apparatus of claim 10 further comprising actuator means selectively positioning said drill shaft between said retracted and extended positions.

12. The apparatus of claim 11 wherein said fluid communication is continuously maintained when said drill shaft is positioned between said retracted and extended positions.

13. The apparatus of claim 11 wherein said actuator means comprise a linear actuator operatively coupled between said first end of said drill shaft and said sleeve member.

14. The apparatus of claim 13 wherein said actuator means further comprise guide means, said guide means comprising a guide rod slidably received in at least one guide loop extending from and attached to an outer surface of said sleeve member.

* * * * *

UNITED STATES PATENT AND TRADEMARK OFFICE

CERTIFICATE OF CORRECTION

PATENT NO. : 7,194,780 B2
APPLICATION NO. : 11/003922
DATED : March 27, 2007
INVENTOR(S) : Jefferson L. Shelton It is certified that error appears in the above-identified patent and that said Letters Patent is hereby corrected as shown below:

On Title Page
Item (73) replace: "Assignee: Halcyon Technologies, Inc., (Jacksonville, AL)"
with --Assignee: Martin Engineering Company, (Neponset, IL)--

Signed and Sealed this

Twentieth Day of November, 2007

JON W. DUDAS
*Director of the United States Patent and Trademark Office*